US009999292B1

(12) United States Patent
Rainsong

(10) Patent No.: US 9,999,292 B1
(45) Date of Patent: Jun. 19, 2018

(54) DUAL CHARGING CABLE LANYARD

(71) Applicant: Daniel Dean Rainsong, Ames, IA (US)

(72) Inventor: Daniel Dean Rainsong, Ames, IA (US)

( * ) Notice: Subject to any disclaimer, the term of this patent is extended or adjusted under 35 U.S.C. 154(b) by 0 days. days.

(21) Appl. No.: 15/874,354

(22) Filed: Jan. 18, 2018

(51) Int. Cl.

| | |
|---|---|
| ***A45F 4/00*** | (2006.01) |
| ***H01R 25/00*** | (2006.01) |
| ***H01R 13/625*** | (2006.01) |
| ***H01R 31/06*** | (2006.01) |
| *A45F 5/00* | (2006.01) |

(52) U.S. Cl.
CPC ..... *A45F 4/00* (2013.01); *A45F 5/00* (2013.01); *H01R 13/625* (2013.01); *H01R 25/003* (2013.01); *H01R 31/06* (2013.01); *A45F 2004/003* (2013.01); *A45F 2005/006* (2013.01); *A45F 2200/0516* (2013.01); *H01R 2201/16* (2013.01)

(58) Field of Classification Search
CPC ..... A45F 4/00; A45F 5/00; A45F 2004/003; A45F 2005/006; A45F 2200/0516; A45F 2005/002; H01R 13/625; H01R 25/003; H01R 31/06; H01R 2201/16; H01R 33/90; H01R 31/065
USPC ..... 439/311, 668, 660; 224/576; 174/69; 24/634, 648
See application file for complete search history.

(56) References Cited

U.S. PATENT DOCUMENTS

| | | | | |
|---|---|---|---|---|
| 7,416,099 | B2 * | 8/2008 | deLeon | H04M 1/05 224/188 |
| 7,699,664 | B2 | 4/2010 | Kim et al. | |
| 9,059,777 | B2 * | 6/2015 | Shattuck | H04M 1/05 |
| 9,787,808 | B1 * | 10/2017 | Gyasi | H04M 1/0274 |
| 2010/0123006 | A1 * | 5/2010 | Chen | G06K 7/0021 235/441 |
| 2015/0126070 | A1 * | 5/2015 | Candelore | H01R 33/90 439/628 |
| 2016/0183668 | A1 | 6/2016 | Grossman et al. | |

* cited by examiner

*Primary Examiner* — Edwin A. Leon
(74) *Attorney, Agent, or Firm* — Dale J. Ream

(57) ABSTRACT

A dual charging cable lanyard for use with a mobile phone includes a first cable and a second cable each having a data or charging connector at first ends, respectively. The lanyard includes a connector bride having receiving ports at opposite ends for receiving the data or charging connectors of the pair of cables so as to form a neck strap. The lanyard includes a cell phone holding member. Opposing ends of the first and second cables are received into a single signal port and is selectively received into the cell phone holding member for connection to a cell phone. The lanyard includes a dual action safety assembly intermediate the signal port and holding member for preventing inadvertent release of the cell phone holder from the cables.

13 Claims, 10 Drawing Sheets

DUAL CHARGING CABLE LANYARD

BACKGROUND OF THE INVENTION

This invention relates generally to lanyards for suspending articles from a wearer's neck and, more particularly, to a lanyard that suspends and secures a cell phone from one's neck and which integrates a pair of charging or data communication cables for use with the cell phone.

A lanyard, by definition, is a cord passed around a user's neck for securing an object, such as to make the object immediately accessible or prevent damage or loss of the object. A lanyard is often the perfect solution for persons who want to keep their cell phone protected from loss or damage while also keeping it immediately accessible for use. A lanyard is a cord or strap that at one end may be worn around a user's neck or wrist and at an opposite end may be coupled to a phone, camera, keys, or other item that may otherwise become lost or damaged. A lanyard for holding a cell phone is particularly useful for doctors, nurses, photographers, electronic game players or anyone who is likely to be carrying or holding multiple devices other than just a phone.

Various types of lanyards have been marketed or proposed as an accessory for carrying one's mobile computing device, such as a cell phone. Although presumably effective for their intended purposes, the existing lanyards still require charging or data cables to be carried or made available. Further, existing lanyards may not reliably secure a phone or phone case such that the phone may still become lost or damaged.

Therefore, it would be desirable to have a lanyard for securing a cell phone in which the lanyard cord includes a pair of charging cables for charging the phone. Further, it would be desirable to have a lanyard having a double-action safety assembly coupled to a cell phone or holder so as to prevent inadvertent release of the cell phone from the lanyard. In addition, it would be desirable to have a lanyard that is length-adjustable, light-weight, and waterproof.

SUMMARY OF THE INVENTION

A dual charging cable lanyard for use with a mobile phone according to the present invention includes a first cable and a second cable each having a data or charging connector at first ends, respectively. The lanyard includes a connector bride having receiving ports at opposite ends for receiving the data or charging connectors of the pair of cables so as to form a neck strap. The lanyard includes a cell phone holding member. Opposing ends of the first and second cables are received into a single signal port and is selectively received into the cell phone holding member for connection to a cell phone. The lanyard includes a dual action safety assembly intermediate the signal port and holding member for preventing inadvertent release of the cell phone holder from the cables.

Therefore, a general object of this invention is to provide a lanyard for suspending a cell phone from around a user's neck.

Another object of this invention is to provide a lanyard, as aforesaid, in which the lanyard cord include a pair of charging or data cables associated with the cell phone.

Still another object of this invention is to provide a lanyard, as aforesaid, having a dual action safety assembly to prevent inadvertent release of a cell phone or case.

Yet another object of this invention is to provide a lanyard, as aforesaid, that is length adjustable, waterproof, lightweight, and convenient to use.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
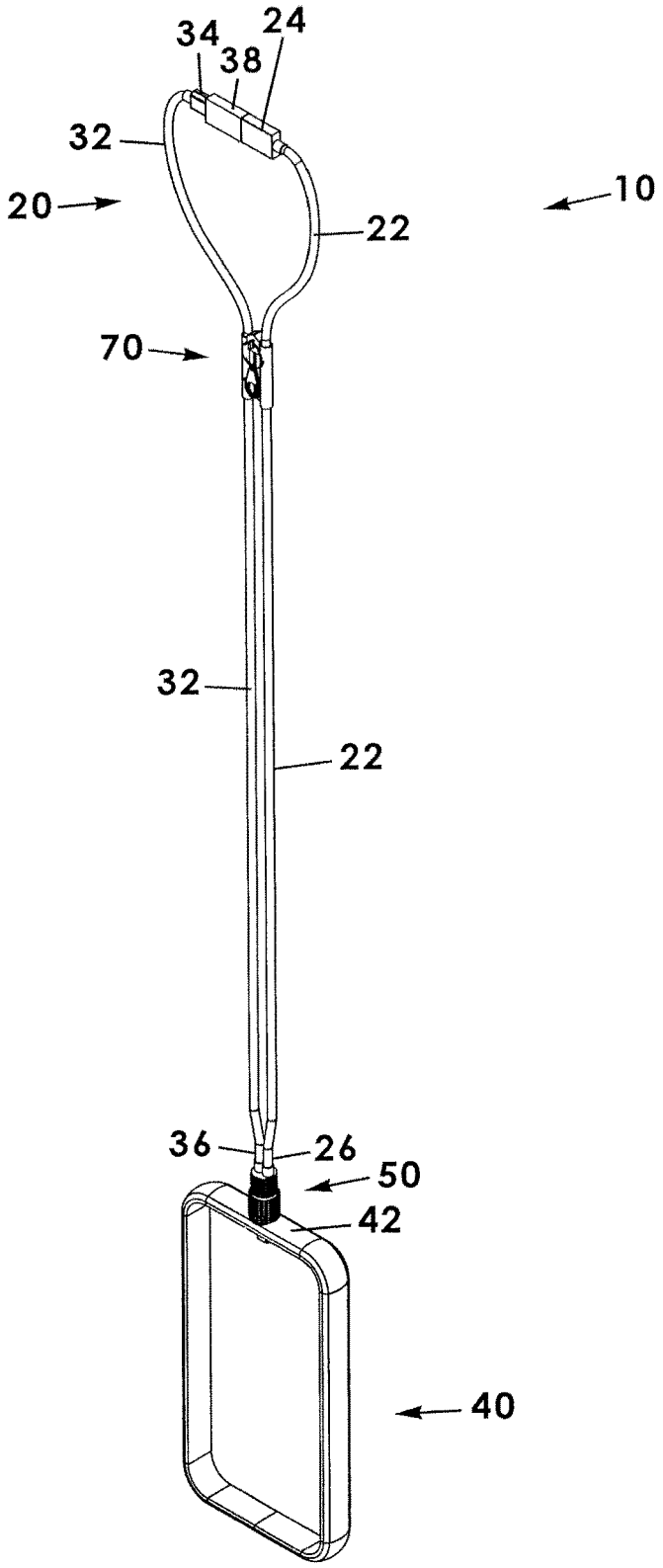
FIG. 1 is a perspective view of a dual charging cable lanyard according to a preferred embodiment of the present invention.

A dual charging cable lanyard according to a preferred embodiment of the present invention will now be described with reference to FIGS. 1 to 11*c* of the accompanying drawings. The dual charging cable lanyard 10 includes a first cable 22, a second cable, a connector bridge member 38, holding member 40, dual action safety assembly 50, and zipper assembly 70.

The dual charging cable lanyard 10 includes a pair of cables capable of both charging and transferring data to or from a mobile computing device. For the specific context described in this application, the "mobile computing device" will be described as a cell phone although the principles and structures described herein would also work with other computing devices, such as a digital camera, tablet, small laptop computer, personal data assistant, other small electronic device. Further, it will be understood that a USB (Universal Serial Bus) cable and a micro-USB cable and variations thereof are capable of charging an electronic device, receiving current from a battery of another electronic device, and transferring data to or from the electronic device. The pair of cables described herein are capable of both functions described above and are combined in a unique manner so as to form a lanyard neck strap 20 that may be worn about the neck of a user and from which a cell phone or other portable electronic device may be secured.

Accordingly, a first cable 22 includes a first end 24 that includes a USB connector. Similarly, a second cable 32 includes a first end 34 that includes a micro-USB connector. It may be desirable to use one cable or the other with a cell phone and it is advantageous to have both cables immediately available for use with a cell phone depending on what type of connectivity to other devices may be available to a user. For instance, a user may desire to connect his cell phone to a personal computer using a USB connection for maximum data transfer speed. On another occasion, the user may simply desire to connect his cell phone to an external source of electricity for charging the phone's battery and the micro-USB cable may be most desired for this application.

Figure 2A:
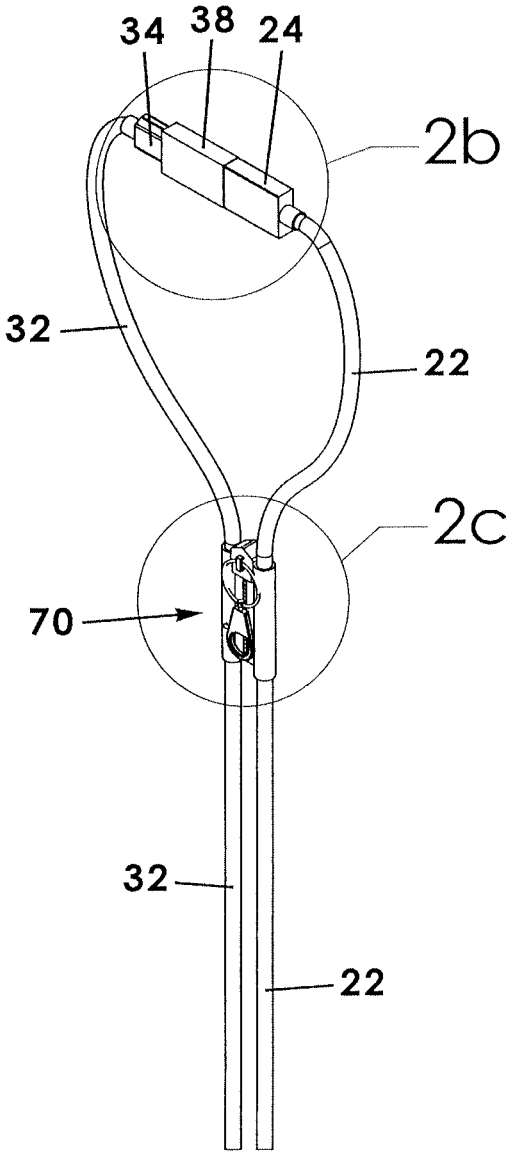
FIG. 2*a* is a fragmentary view of the dual charging cable lanyard as in FIG. 1.
Figure 2B:
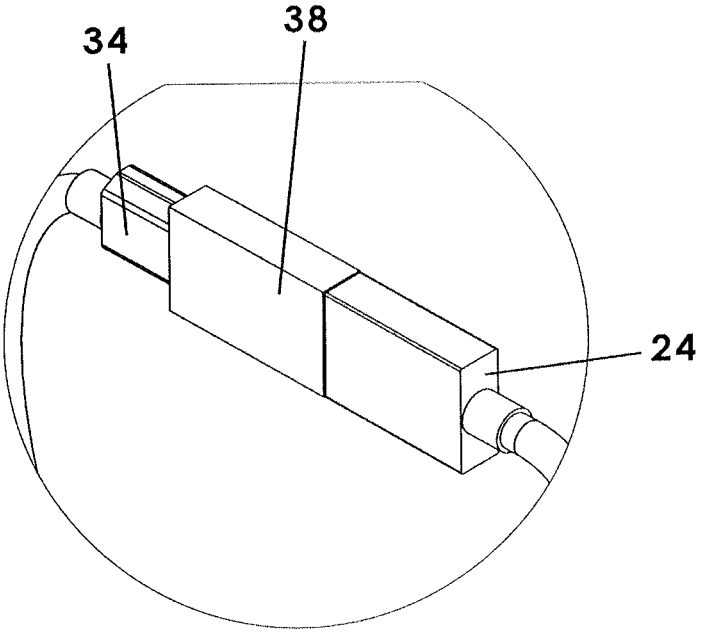
FIG. 2*b* is an isolated view on an enlarged scale taken from FIG. 2*a;*
Figure 2C:
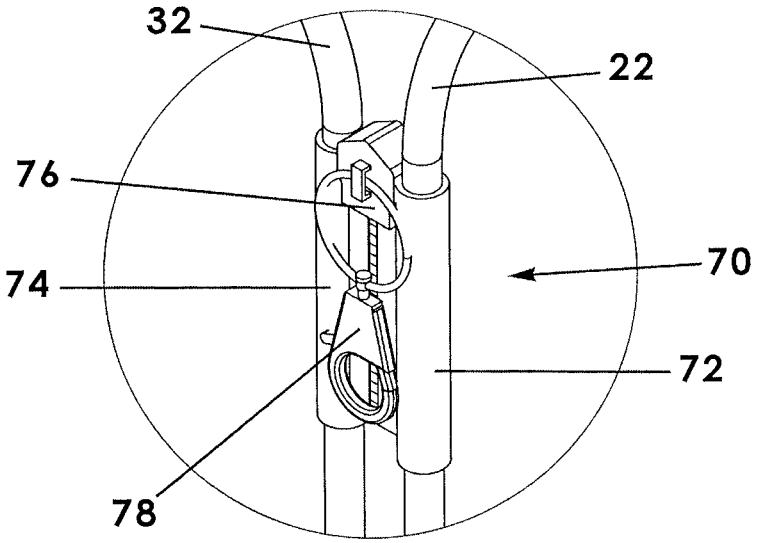
FIG. 2*c* is an isolated view on an enlarged scale taken from FIG. 2*a;*
Figure 3:
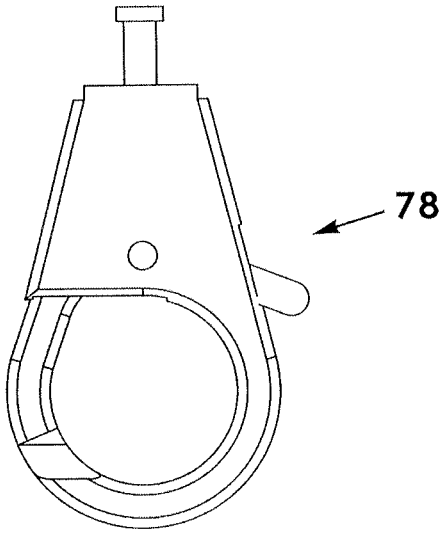
FIG. 3 is an isolated view on enlarged scale take from FIG. 2*a*, illustrated with the fastener in a closed configuration.
Figure 4:
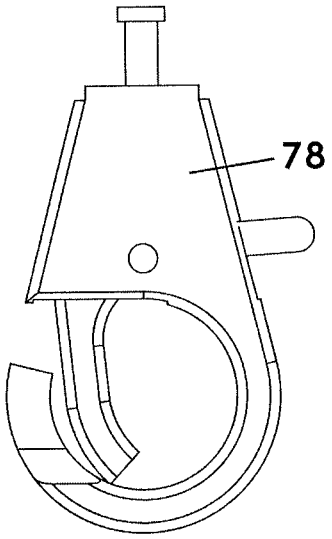
FIG. 4 is an isolated view on enlarged scale take from FIG. 2*a*, with the fastener illustrated in an open configuration.
Figure 5:
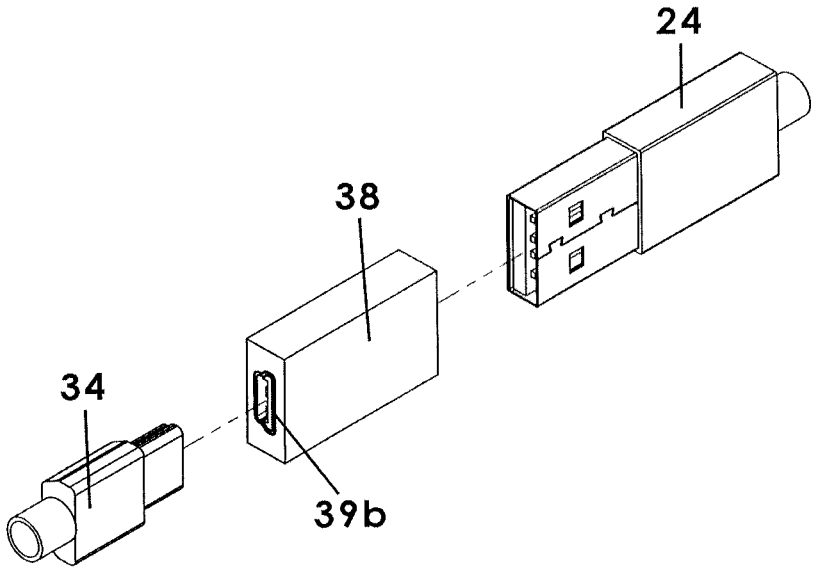
FIG. 5 is an exploded view from one angle of the connector bridge member and respective USB connectors according to the present invention.
Figure 6:
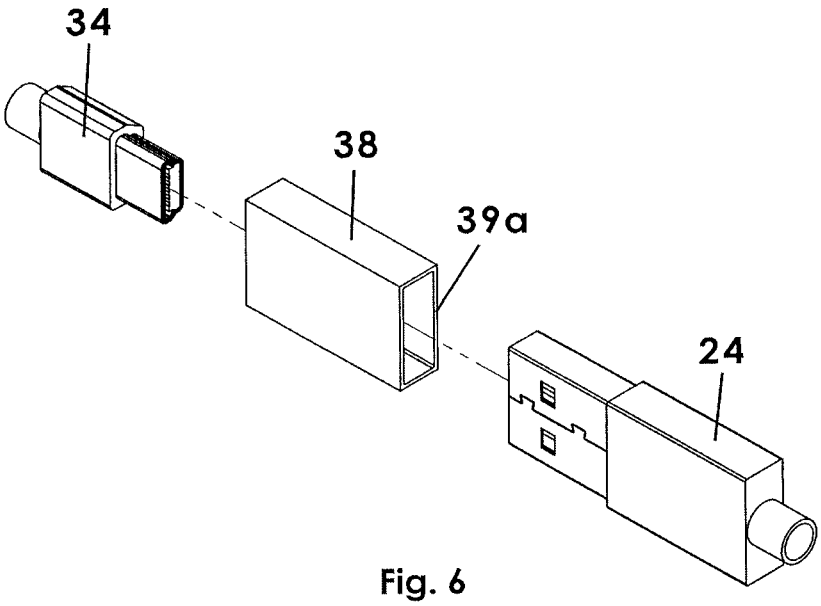
FIG. 6 is an exploded view from another angle of the connector bridge member and respective USB connectors according to the present invention.
Figure 7:
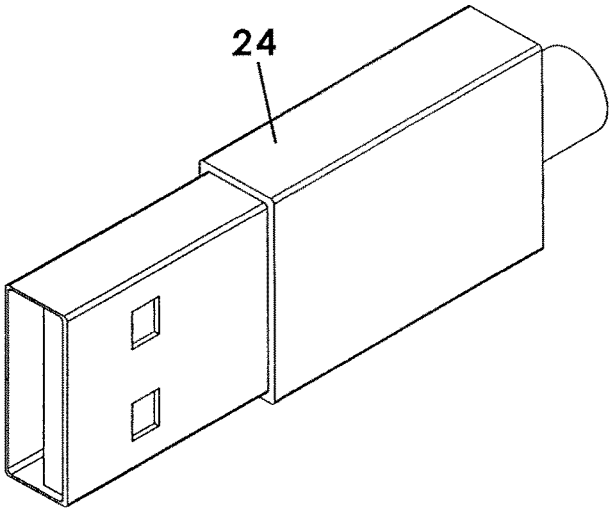
FIG. 7 is an isolated view on an enlarged scale of a USB connector as in FIG. 5.
Figure 8:
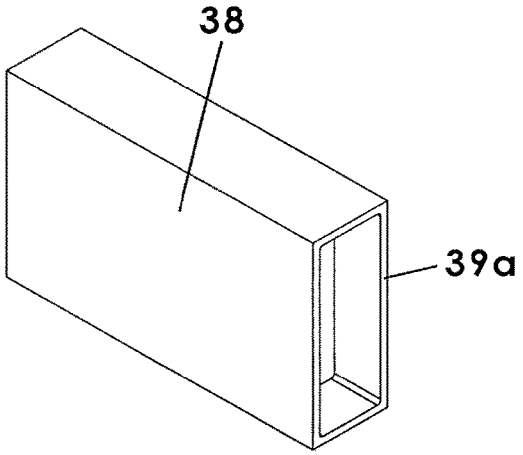
FIG. 8 is an isolated view on an enlarged scale of a connector bridge member as in FIG. 5.
Figure 9:
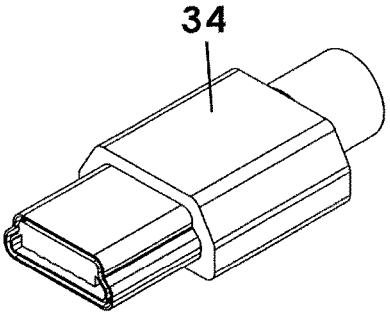
FIG. 9 is an isolated view on an enlarged scale of a micro-USB connector as in FIG. 5.

Now, the pair of cables described above may be used with a connector bridge member 38 to form a neck strap 20. The connector bridge member 38 may include a housing having a generally rectangular configuration capable of receiving the first ends of the first cable 22 and second cable 32, respectively (FIGS. 5 and 6). A first end of the connector bridge member 38 may include a USB receiving port 39*a* (which may simply define an opening into an interior space defined by the connector bridge member 38). Similarly, a second end opposed to the first end may include a micro-USB receiving port 39*b*, each port being complementary and cable of receiving a corresponding USB or micro-USB connector of the first cable 22 and second cable 32, respectively. In use, respective connectors may be plugged in to respective receiving ports so that the cables, collectively, define a lanyard neck strap that may be worn around the neck of a user (FIG. 2*a*).

Figure 11A:
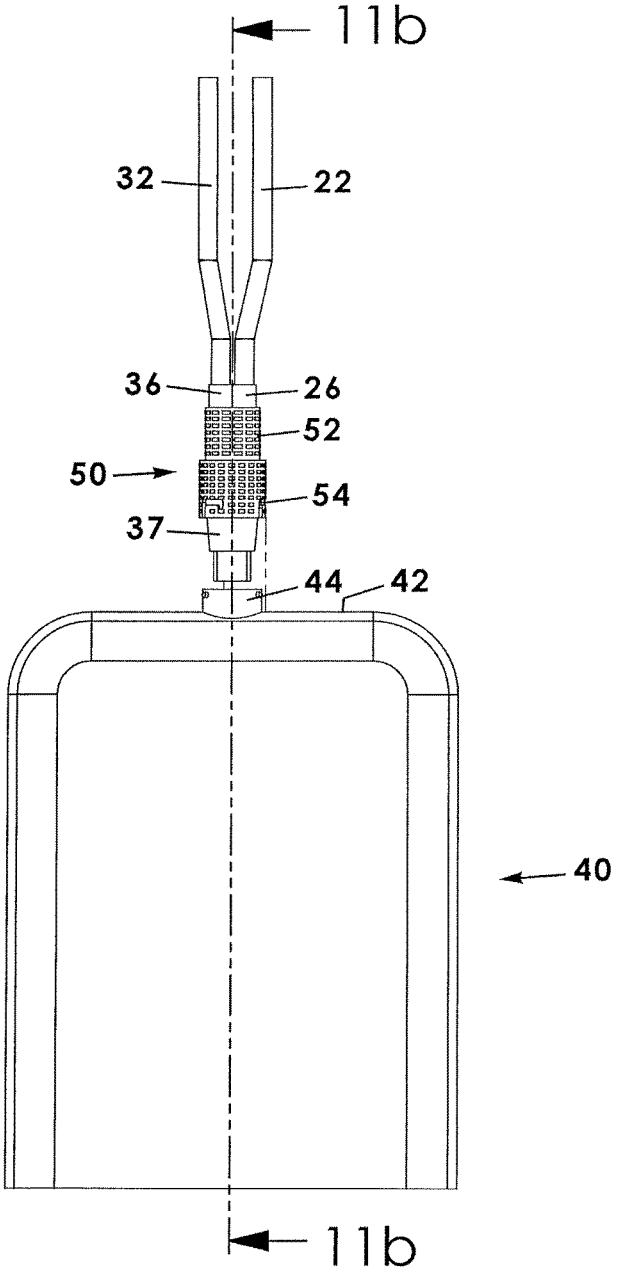
FIG. 11*a* is a front view of the dual charging cable lanyard as in FIG. 10*a;*
Figure 11B:
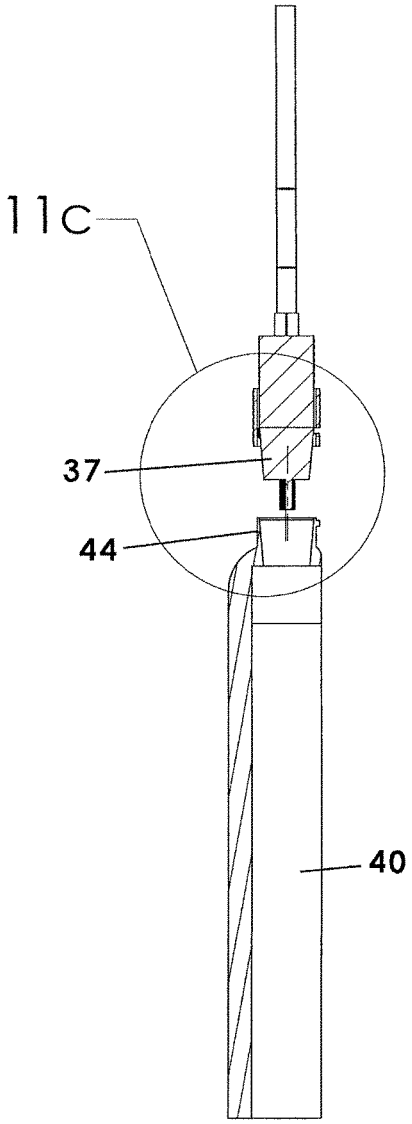
FIG. 11*b* is a sectional view taken along line 11*b*-11*b* of FIG. 11*a*.
Figure 11C:
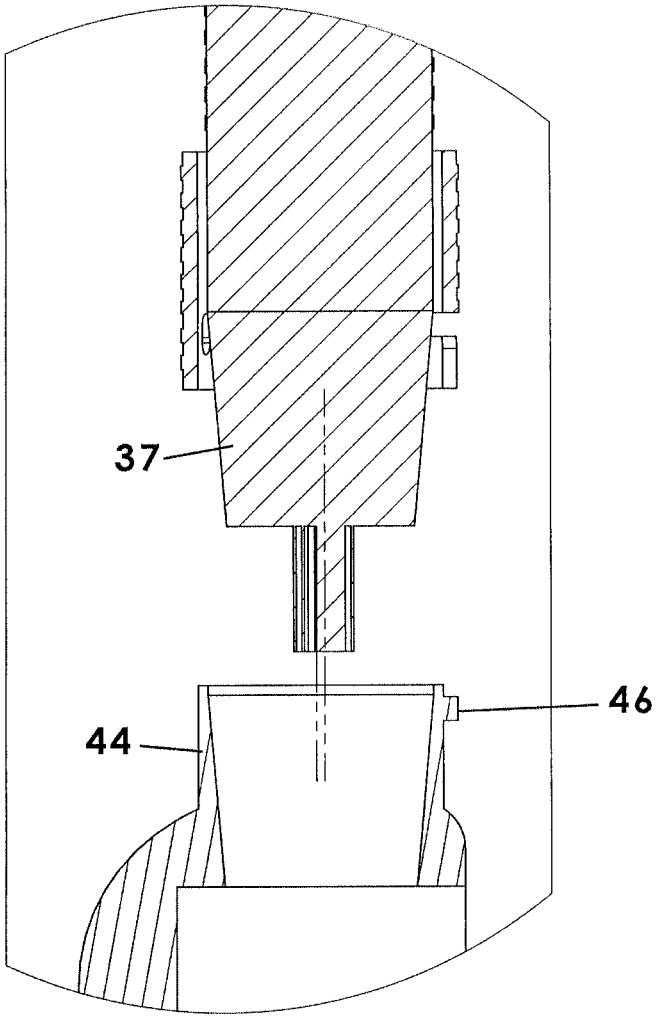
FIG. 11*c* is an isolated view on enlarged scale taken from FIG. 10*b*.

Each of the first cable 22 and second cable 32 includes a second end 26, 36 opposed to corresponding first ends 24, 34, respectively. Although it may be hidden, the second end 26 of the first cable 22 may include a USB connector configuration and the second end 36 of the second cable 32 may include a micro-USB connector configuration. Then, the second ends 26, 36 may be joined and coupled to an upper portion of a single signal port 37 (FIGS. 11*a* to 11*c*). The single signal port 37, therefore, is essentially a junction allowing a signal (e.g. an electrical charge or data stream) to pass from a respective first cable 22 or second cable 32 to a cell phone via its lower portion as described below, or vice versa.

In another aspect, the dual charging cable lanyard 10 includes a holding member 40 capable of holding a mobile electronic device such as a smart phone or the like. Preferably, the holding member 40 does not interfere with access to either the front buttons or display screen of a phone or even buttons on the side. In its simplest form, the holding member 40 may include a top wall 42, a bottom wall, and connecting side walls. The top wall 42 may define an aperture and may include a receiving member 44 extending upwardly and defining a channel therethrough. As will become evident below, the signal port 37 electrically connected to the pair of cables may be received through the receiving member 44 (FIG. 11*c*) and into an interior area defined by the holding member 40 for selective connection to and communication with a cell phone secured in the holding member 40. Once connected, communication of electrical current or data may flow between the cell phone and a power source or data source.

Figure 10A:
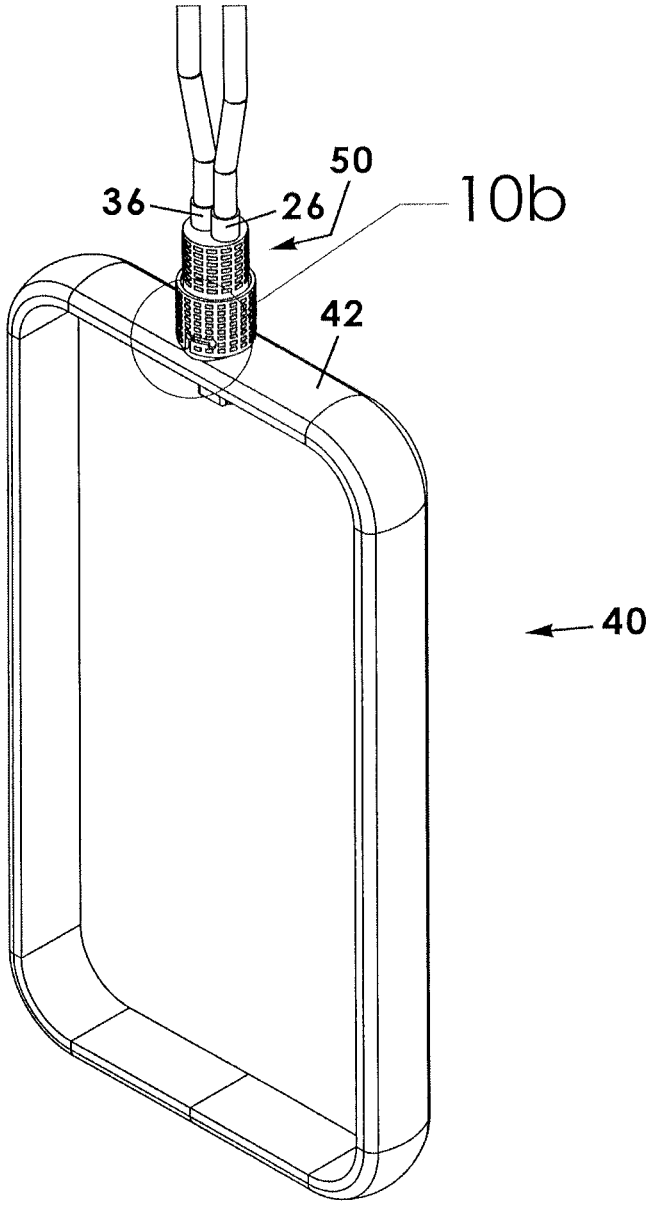
FIG. 10*a* is a partial perspective view of the dual charging cable lanyard as in FIG. 1.
Figure 10B:
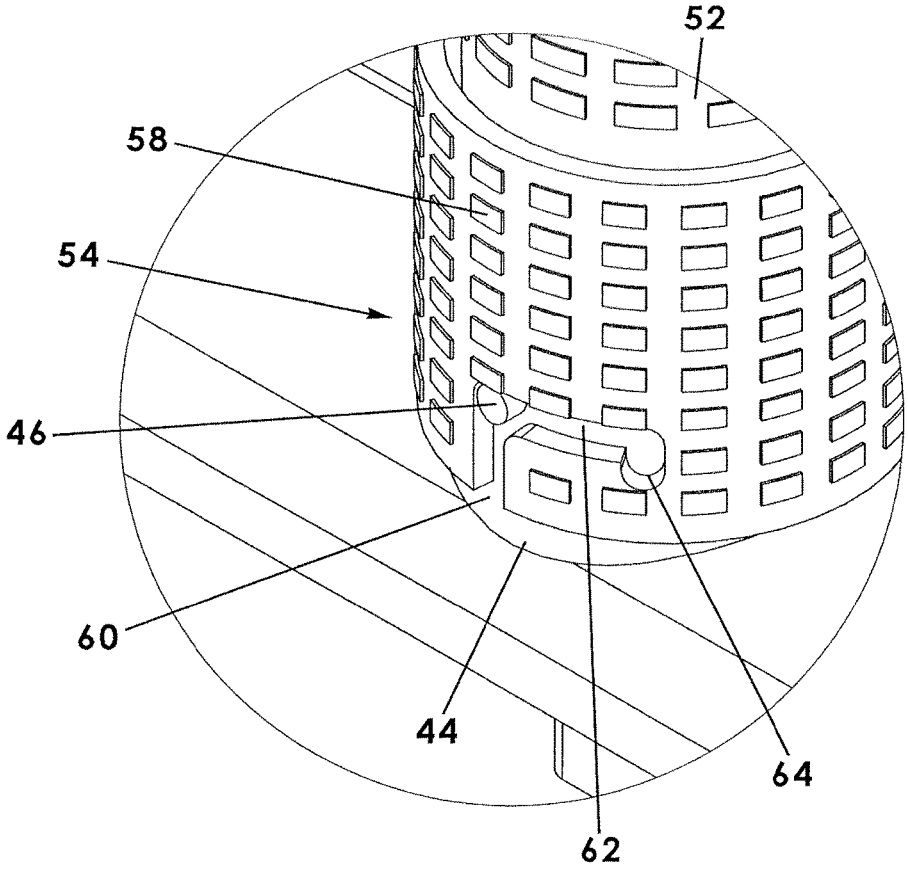
FIG. 10*b* is an isolated view on enlarged scale take from FIG. 10*a;*

In another aspect, the dual charging cable lanyard 10 may include a dual action safety assembly 50 specifically designed to prevent the cell phone holding member 40 from being released or detached inadvertently from the neck strap 20. The dual action safety assembly 50 is best shown in FIGS. 10*a* and 10*b* and requires both a vertical movement (e.g. up/down) and a horizontal movement (i.e. rotation) before the safety assembly 50 may be released from the receiving member 44 of the holding member 40. The dual action safety assembly 50 includes an upper portion 52 and a lower portion 54. The lower portion 54 includes a continuous side wall 56 defining an interior channel extending between an open top and open bottom through which at least the lower portion of the signal port 37 extends into the interior area of the holding member 40 when the dual action safety assembly 50 is attached to the holding member 40. An exterior surface of the side wall 56 may include a plurality of nubs 58 or another type of gripping members so that it may be grasped by a user's fingers more effectively.

The receiving member 44 includes a locking flange 46 extending outwardly. Correspondingly, the side wall of the lower portion 54 of the safety assembly 50 defines a vertical slot 60 dimensioned to selectively receive the locking flange 46. Further, the side wall of the lower portion 54 defines a horizontal slot 62 in communication with the vertical slot 60 and extending horizontally away therefrom. Then, a distal end of the horizontal slot 62 defines a recess 64 configured to receive the locking flange 46 in a nested relationship when the lower portion 54 is rotated to a locked configuration. In an embodiment, the upper portion 52 and lower portion 54 may be rotatably coupled together to allow movement of the lower portion 54 independent of the upper portion 52. In use, the safety assembly 50 may be aligned such that the vertical slot 60 receives the locking flange 46. Then, the lower portion 54 may be rotated such that the locking flange 46 slides along the horizontal slot 62 until it drops into the recess 64. To unlock, the dual action safety assembly 50 must be pressed down to disengage the locking flange 46 from the recess 64 and the rotation reversed.

In another aspect, the dual charging cable lanyard 10 includes a zipper assembly 70 that enables the entire device to be fastened to another article for storage if not being carried around the neck and also allows tightening, loosening, and adjusting the length of the pair of cables. Now more particularly, the zipper assembly 70 includes a first guide tube 72 dimensioned to receive and guide the first cable 22 therethrough. Similarly, the zipper assembly 70 includes a second guide tube 74 dimensioned to receive and guide the second cable 32 therethrough. A zipper 76 literally connects the guide tubes 72, 74, the zipper being movable in an up/down manner so as to tighten or loosen the tubes' adjacent configuration and, as a result, allow then neck strap 20 to be tightened or loosened around the neck of a user. The entire zipper assembly 70 may be slidably moved upward or downward on respective cables as the tubes are slidable along the cables. Further, the zipper assembly 70 may include a quick connect fastener 78 by which the entire dual charging cable lanyard 10 may be coupled. The fastener 78 may be fastener is one of a carabiner, a latch, a clasp, a hook, a ring, a strap, a magnet, a snap, or the like.

In use, a user may insert his cell phone into the holding assembly the dual action safety assembly 50 may be locked to the holding member as described above. Respective first ends 24, 34 of the first cable 22 and second cable 32 may be coupled to respective ends of the connector bridge member 38 to form the lanyard neck strap 20. When desired, either the USB connector or micro-USB connector (of the first cable 22 and second cable 32, respectively) may be plugged into a charging device or data device. The current therefrom is then passed to the signal port 38 plugged into the cell phone in the holding member 40 as described above.

It is understood that while certain forms of this invention have been illustrated and described, it is not limited thereto except insofar as such limitations are included in the following claims and allowable functional equivalents thereof.

The invention claimed is:

1. A dual charging cable lanyard for use with a mobile computing device, comprising:

a first cable having a first end that includes a USB connector and a second end opposite said first end that includes a USB connector;

a second cable having a first end that includes a micro-USB connector and a second end opposite said first end that includes a micro-USB connector;

a connector bridge member having a first end that includes a USB receiving port and having a second end that includes a micro-USB receiving port so that said first end of said first cable and said first end of said second cable area are selectively coupled to said connector bridge for forming, collectively, a neck strap;

a holding member for holding the mobile computing device;

a signal port having an upper portion in electrical communication with said USB connector at said second end of said first cable and with said micro-USB connector at said second end of said second cable and having a lower portion operatively and releasably positioned in said holding member for electrical connection to the mobile computing device.

2. The dual charging cable lanyard as in claim 1, wherein:

said holding member includes a top wall and a receiving member extending upwardly from said top wall that defines a channel, said receiving member having a locking flange extending outwardly therefrom;

said channel is configured to receive said signal port into an open area of said holding member.

3. The dual charging cable lanyard as in claim 2, wherein said dual charging cable lanyard further includes:

a safety assembly having a continuous side wall defining an open top, an open bottom, and an interior channel therebetween, said signal port extending through said interior channel and through said open bottom;

wherein said side wall of said safety assembly defines a vertical slot in communication with a horizontal slot, said vertical and horizontal slots having a configuration complementary to a configuration of said locking flange for selectively receiving said locking flange therein.

4. The dual charging cable lanyard as in claim 3, wherein a distal end of said horizontal slot defines a recess for receiving said locking flange.

5. The dual charging cable lanyard as in claim 4, wherein said safety assembly is a dual-action locking assembly for locking or releasing said holding member to said safety assembly.

6. The dual charging cable lanyard as in claim 1, further comprising a zipper fastener assembly, including:

a first guide tube coupled to said first cable;

a second guide tube coupled to said second cable;

a zipper intermediate and connecting said first and second guide tubes;

a fastener coupled to said zipper that is movable between an open configuration allow access to an interior area thereof and a closed configuration not allowing access to said interior area thereof.

7. The dual charging cable lanyard as in claim 6, wherein said fastener is one of a carabiner, a latch, a clasp, a hook, a ring, a strap, a magnet, or a snap.

8. A dual charging cable lanyard for use with a mobile computing device, comprising:

a first cable having a first end that includes a USB connector and a second end opposite said first end that includes a USB connector;

a second cable having a first end that includes a micro-USB connector and a second end opposite said first end that includes a micro-USB connector;

a connector bridge member having a first end that includes a USB receiving port and having a second end that includes a micro-USB receiving port so that said first end of said first cable and said first end of said second cable area are selectively coupled to said connector bridge for forming, collectively, a neck strap;

a holding member for holding the mobile computing device;

a signal port having an upper portion in electrical communication with said USB connector at said second end of said first cable and with said micro-USB connector at said second end of said second cable and having a lower portion operatively and releasably positioned in said holding member for electrical connection to the mobile computing device;

wherein:

said holding member includes a top wall and a receiving member extending upwardly from said top wall that defines a channel, said receiving member having a locking flange extending outwardly therefrom;

said channel is configured to receive said signal port into an open area of said holding member.

9. The dual charging cable lanyard as in claim 8, wherein said dual charging cable lanyard further includes:

a safety assembly having a continuous side wall defining an open top, an open bottom, and an interior channel therebetween, said signal port extending through said interior channel and through said open bottom;

wherein said safety assembly is a dual-action locking assembly for locking or releasing said holding member to said safety assembly.

10. The dual charging cable lanyard as in claim 9, wherein said side wall of said safety assembly defines a vertical slot in communication with a horizontal slot, said vertical and horizontal slots having a configuration complementary to a configuration of said locking flange for selectively receiving said locking flange therein.

11. The dual charging cable lanyard as in claim 10, wherein a distal end of said horizontal slot defines a recess for receiving said locking flange.

12. The dual charging cable lanyard as in claim 9, further comprising a zipper fastener assembly, including:

a first guide tube coupled to said first cable;

a second guide tube coupled to said second cable;

a zipper intermediate and connecting said first and second guide tubes;

a fastener coupled to said zipper that is movable between an open configuration allow access to an interior area thereof and a closed configuration not allowing access to said interior area thereof.

13. The dual charging cable lanyard as in claim 12, wherein said fastener is one of a carabiner, a latch, a clasp, a hook, a ring, a strap, a magnet, or a snap.

* * * * *